US007954644B2

(12) United States Patent
Lease et al.

(10) Patent No.: US 7,954,644 B2
(45) **Date of Patent: *Jun. 7, 2011**

(54) SEPARATOR SYSTEM AND METHOD OF SEPARATING MATERIALS

(75) Inventors: Daniel T. Lease, Spring Grove, IL (US); Dan Britton, Barrington, IL (US); Steve C. Wiechmann, Sleepy Hollow, IL (US)

(73) Assignee: General Kinematics Corporation, Crystal Lake, IL (US)

( * ) Notice: Subject to any disclaimer, the term of this patent is extended or adjusted under 35 U.S.C. 154(b) by 93 days.

This patent is subject to a terminal disclaimer.

(21) Appl. No.: 12/435,211

(22) Filed: May 4, 2009

(65) Prior Publication Data

US 2009/0211949 A1 Aug. 27, 2009

Related U.S. Application Data

(63) Continuation of application No. 11/234,981, filed on Sep. 26, 2005, now Pat. No. 7,527,153.

(51) Int. Cl.
*B07B 1/28* (2006.01)

(52) U.S. Cl. ..... 209/314; 209/320

(58) Field of Classification Search ..... 209/233–421
See application file for complete search history.

(56) References Cited

U.S. PATENT DOCUMENTS

| | | | |
|---|---|---|---|
| 126,683 | A | 5/1872 | Custer |
| 798,382 | A | 8/1905 | Allard |
| 3,232,431 | A | 2/1966 | Musschoot et al. |
| 3,335,861 | A | 8/1967 | Musschoot et al. |
| 3,406,824 | A | 10/1968 | Forsberg |
| 3,411,171 | A | 11/1968 | Musschoot et al. |
| 3,989,227 | A | 11/1976 | Musschoot |
| 4,152,255 | A | 5/1979 | Musschoot |
| 4,267,037 | A | 5/1981 | Merz et al. |
| 4,913,804 | A | 4/1990 | Muller |
| 5,108,589 | A | 4/1992 | Sherman |
| 5,950,840 | A | 9/1999 | Thoma |
| 6,715,611 | B2 | 4/2004 | Crabbe et al. |
| 7,527,153 | B2 * | 5/2009 | Lease et al. ..... 209/314 |

OTHER PUBLICATIONS

Partial European Search Report for counterpart European Patent Application No. EP06020147, dated Oct. 21 2009 (5 pp.).

* cited by examiner

*Primary Examiner* — Joseph C Rodriguez
*Assistant Examiner* — Kalyanavenkateshware Kumar
(74) *Attorney, Agent, or Firm* — Marshall, Gerstein & Borun LLP

(57) ABSTRACT

A separator system may include a first trough having an inlet end, a downstream, outlet end and a trough floor, a first screen section supported in the trough spaced from the trough floor, the first screen section having a first end and a second downstream end, a material-retaining surface disposed at the downstream end of the first screen section, the material-retaining surface disposed at an angle relative to the first screen section to limit the movement of material across the first screen section, and a vibratory generator coupled to the trough. The separator system may alternatively or in addition include a gate disposed at the end of the screen section, the gate having a first position and a second position.

16 Claims, 10 Drawing Sheets

SEPARATOR SYSTEM AND METHOD OF SEPARATING MATERIALS

This application is a continuation of U.S. Ser. No. 11/234,981, filed on Sep. 26, 2005, now U.S. Pat. No. 7,527,153, which is hereby incorporated by reference in its entirety in the present application.

BACKGROUND

This patent is directed to a separator system and a method of separating materials, and, in particular, to a vibratory separator system and method of separating a mixed material stream utilizing vibrations.

SUMMARY OF THE INVENTION

In one aspect, a vibratory separator system includes a first trough having an inlet end, a downstream, outlet end and a trough floor, a first screen section supported in the trough spaced from the trough floor, the first screen section having a first end and a second downstream end, a material-retaining surface disposed at the downstream end of the first screen section, the material-retaining surface disposed at an angle relative to the first screen section to limit the movement of material across the first screen section, and a vibratory generator coupled to the trough.

In another aspect, a vibratory separator system includes a first trough having an inlet end, a downstream, outlet end and a trough floor, a first screen section supported in the trough spaced from the trough floor, the first screen section having a first end and a second downstream end, a gate disposed at the end of the first screen section, the gate having a first position and a second position, a vibratory generator coupled to the trough, and first and second conveyors. The first conveyor is disposed proximate to the gate to receive material that passes over the first screen section when the gate is in the first position, and the second conveyor is disposed proximate to the trough floor to receive material that passes along the trough floor and at least a portion of the material that passes over the first screen section when the gate is in the second position.

In still another aspect, a method of separating mixed materials, the method including receiving a mixed material in a trough having a first screen section with a first end and a second downstream end, vibrating the trough to move the mixed material across the first screen section in the direction of the downstream end, limiting the movement of the mixed material past the downstream end of the first screen section to maintain the mixed material on the first screen section for a first duration, collecting a first constituent material below the first screen section, and permitting the remainder of the mixed material to move past the downstream end of the first screen section after the first duration has elapsed.

In yet another aspect, a method of separating mixed materials, the method including receiving a mixed material in a trough having a first screen section with a first end and a second downstream end and a trough floor disposed beneath the first screen section and having a first end and a second downstream end, vibrating the trough to move the mixed material across the first screen section in the direction of the downstream end, collecting a first constituent material on the trough floor, selectively directing the remainder of the mixed material into a first conveyor or into a second conveyor at the downstream end of the first screen section, vibrating the trough to move the first constituent material along the trough floor in the direction of the downstream end, and directing the first constituent material into the second conveyor.

Additional aspects of the disclosure are defined by the claims of this patent.

DETAILED DESCRIPTION OF VARIOUS EMBODIMENTS

Although the following text sets forth a detailed description of different embodiments of the invention, it should be understood that the legal scope of the invention is defined by the words of the claims set forth at the end of this patent. The detailed description is to be construed as exemplary only and does not describe every possible embodiment of the invention since describing every possible embodiment would be impractical, if not impossible. Numerous alternative embodiments could be implemented, using either current technology or technology developed after the filing date of this patent, which would still fall within the scope of the claims defining the invention.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. §112, sixth paragraph.

Figure 1:
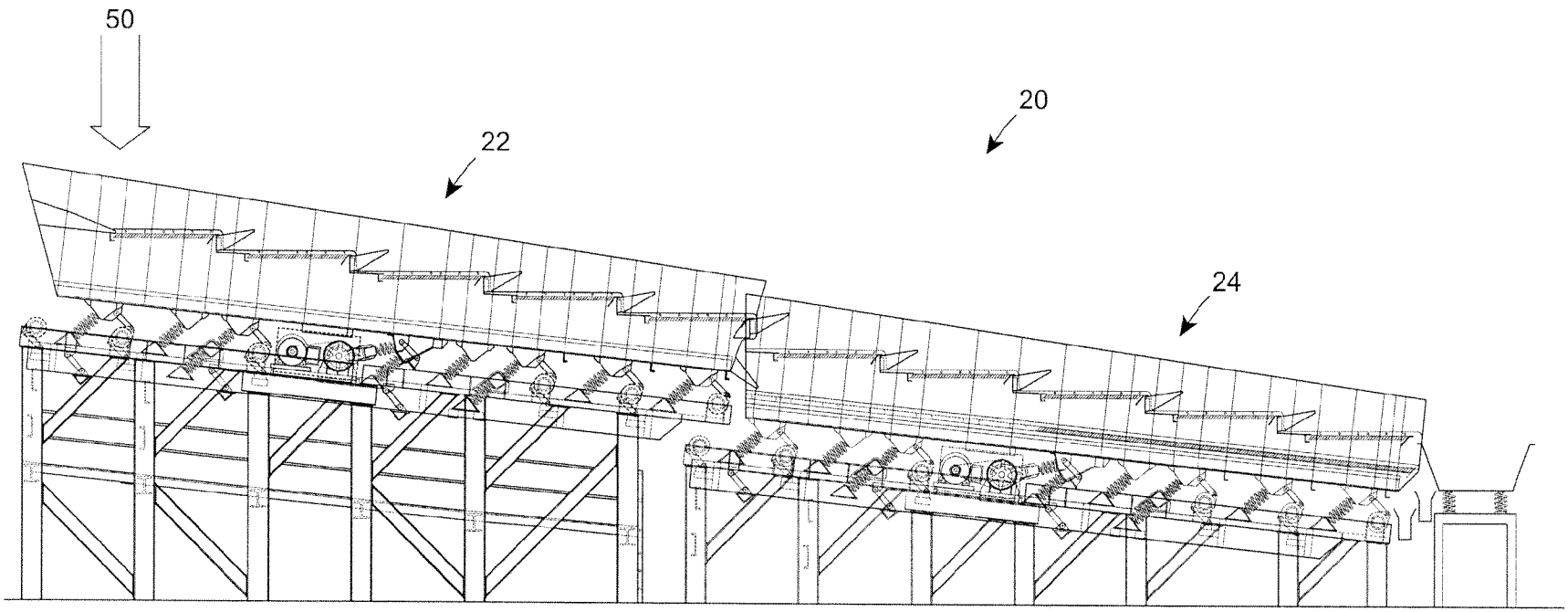
FIG. 1 is a side view of an embodiment of a vibratory separator system according to the present disclosure.

FIG. 1 illustrates an embodiment of a separator system 20 for separating a mixed material stream into a set of constituent material streams, wherein the mixed material stream may include not only separately-formed constituent materials of various sizes, but wherein the constituent materials may be attached to or interact with each other in some fashion. The separator system 20 according to the present disclosure may not only separate the mixed stream into constituent streams, which may include separating the attached or interacting constituent materials, the separator system 20 may also transport the material streams from one location to another. Further, according to certain embodiments of the separator system 20, the separator system 20 may provide a mechanism for remixing the constituent material streams to define a blended material stream.

As shown in FIG. 1, the separator system 20 may include a first stage separator 22 and a second stage separator 24, although it is not critical to include two stages and, for example, the system 20 may include only the second stage separator 24. The two stages 22, 24 of the separator system 20, as illustrated, may have many features that are similar. Those features that are similar are numbered similarly in the Figures, with the similar features of the second stage separator 24 denoted with a prime. However, there are also certain features of the first stage 22 that are not found in the second stage 24, and vice versa. These features are numbered uniquely.

Figure 2:
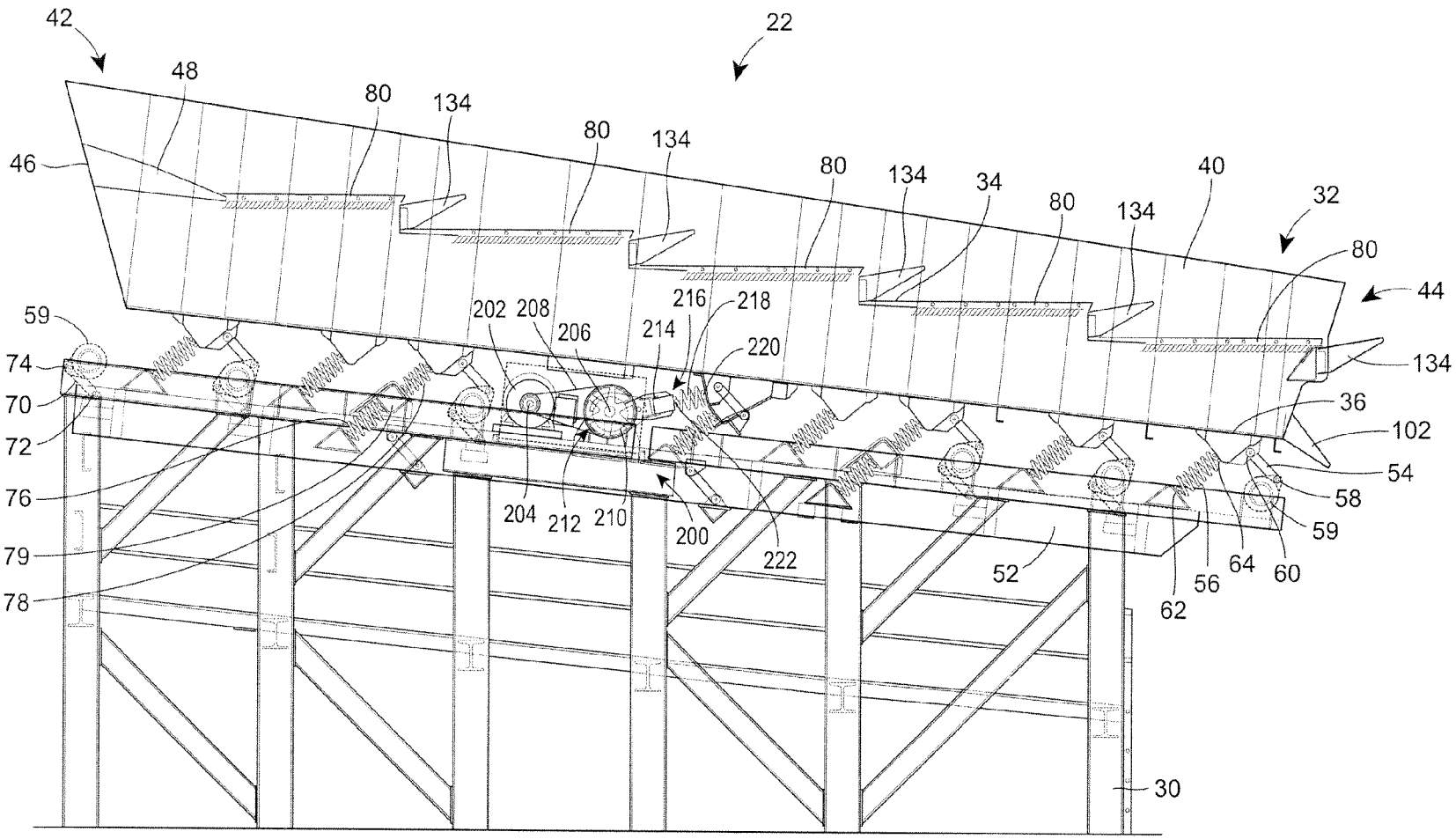
FIG. 2 is a side view of a first stage separator of the system illustrated in FIG. 1.

Turning first to FIG. 2, the first stage separator 22 may include a frame 30 that may, in turn, be coupled (by anchor bolts secured in concrete, for example) to a supporting structure, such as a plant floor. The first stage separator 22 also may include a trough 32 along which material streams may pass, which trough 32 may be coupled to the frame 30 as explained in greater detail below. According to the illustrated embodiment, the trough 32 may include a separation deck 34, a trough floor 36 and opposing, spaced side walls 38, 40 (see, e.g., FIG. 3) that are attached to the separation deck 34 and the trough floor 36 such that the separation deck 34 is spaced from the trough floor 36.

The trough 32 has a first, inlet end 42 and a second, downstream, outlet end 44. An end wall 46 may be attached to the side walls 38, 40, the trough floor 36, and the separation deck 34 at the first end 42. By contrast, the outlet end 44 of the trough 32 may be open to permit material or material streams to pass therethrough.

Figure 3:
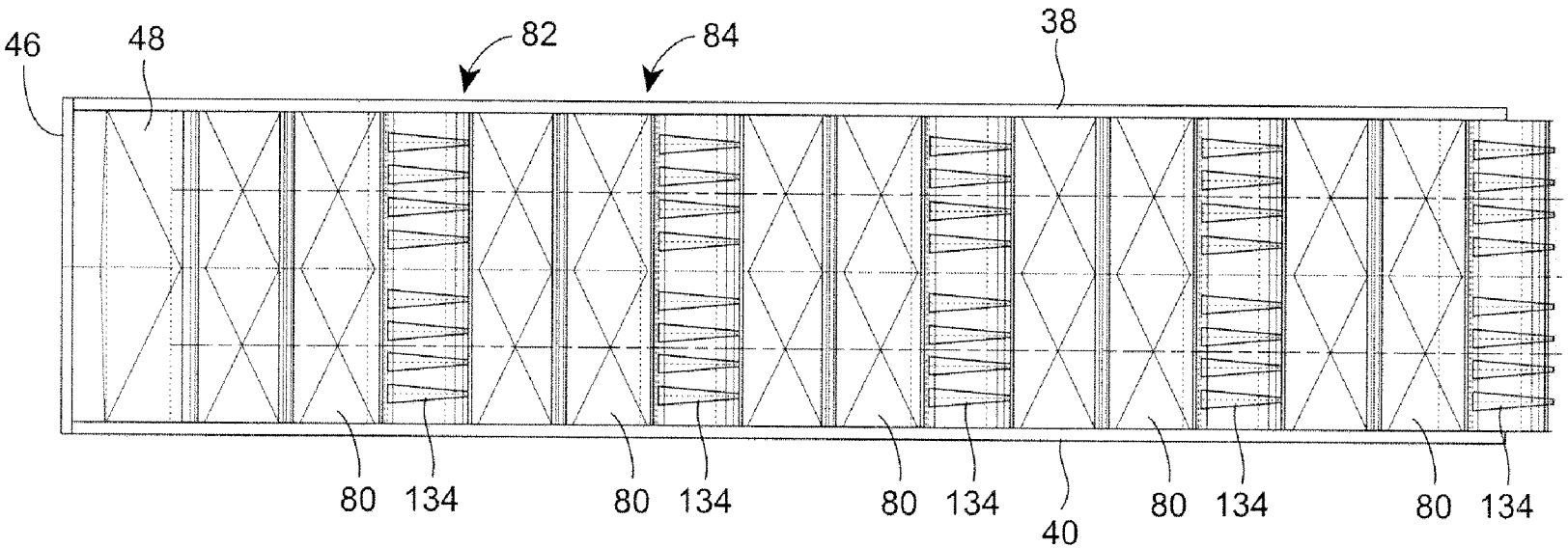
FIG. 3 is a plan view of the first stage separator of FIG. 2.
Figure 4:
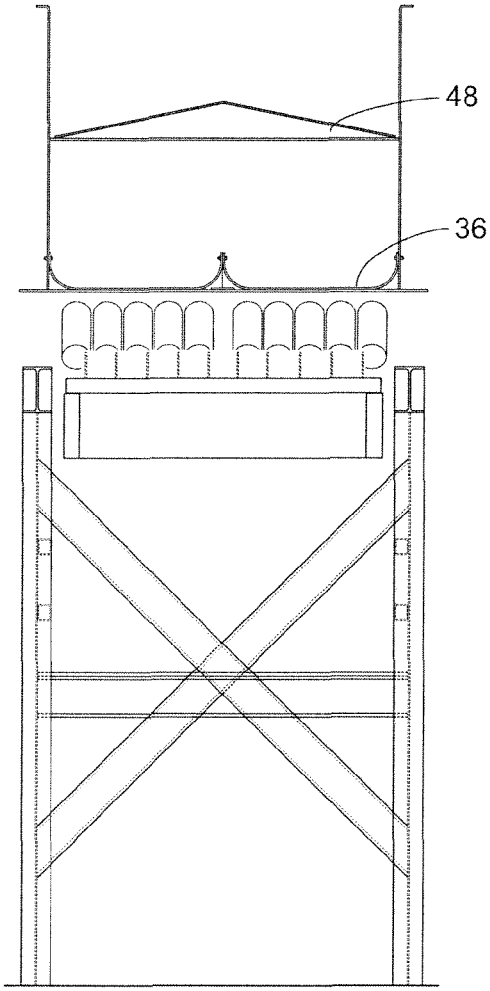
FIG. 4 is an end view of the first stage separator of FIG. 2 taken at the inlet end of the first stage separator.

At seen in FIGS. 2, 3, and 4, the first stage separator 22 may also include an inclined plate 48 that is attached to the separation deck 34, the side walls 38, 40, and the end wall 46 at the inlet end 42 of the trough 32. The inclined plate 48 may be disposed beneath a source 50 of a mixed material stream to be separated, which source 50 is designated schematically in FIG. 1 by a down arrow. The inclined plate 48 may assist in directing the mixed material stream down the length of the first stage separator 22, which separator 22 may also be inclined relative to horizontal to further assist in directing the material streams down its length.

Returning to FIG. 2, the trough 32 may be coupled to the frame 30 and to a counterbalance 52, which may also be attached to the frame 30. As illustrated, the trough 32 may be coupled to the frame 30 by a plurality of rigid links 54 and to the counterbalance 52 by a plurality of resilient members 56. The rigid links 54 may each be pivotally attached at a first end 58 to the frame 30 via a support structure (for example, a tube) 59 and at a second end 60 to the trough 32, and the angle formed between each rigid link 54 and the trough floor 36 may be an obtuse angle. The resilient members 56, which may be compression springs, may each be fixedly attached at a first end 62 to the counterbalance 52 and at a second end 64 to the trough 32, and the angle formed between each resilient member 56 and the trough floor 36 may be an acute angle. As illustrated, the plurality of links 54 and the plurality of resilient members 56 may be disposed in pairs, with the ends 60 of the links 54 and ends 64 of the resilient members 56 that make up each pair being attached to the trough 32 adjacent to each other. The counterbalance 52 may also be coupled to the frame 30 by rigid links 70 that are connected at a first end 72 to the counterbalance 52 and at a second end 74 to a tube 59. Additionally, the trough 32 and the counterbalance 52 may also be coupled via resilient members 76, 78, which may be springs, to the frame 30 via a support structure 79.

As also seen in FIGS. 2 and 3, disposed on the separation deck 34 may be at least one screen section 80. As illustrated, five separation deck sections 80 are disposed on the separation deck 34 of the first stage separator 22. According to other embodiments, a greater or lesser number of screen sections 80 may be included.

As best seen in FIG. 3, each screen section 80 may have a first, upstream end 82 and a second, downstream end 84. As best seen in FIG. 2, the upstream and downstream ends 82, 84 of each screen section 80 may be disposed at an approximately equal elevation, relative to the horizontal. However, the upstream end 82 of each successive screen section 80 may be disposed at a lower elevation, relative to the horizontal, than the downstream end 84 of the preceding deck section 80. Further, the upstream and downstream ends 82, 84 of adjacent deck sections may be spaced, as illustrated, although this is not necessarily true for all embodiments.

Each screen section 80, as illustrated, includes two screens 86, which according to the present embodiment are finger screens, similar to those disclosed in U.S. Pat. No. 5,108,589, which is incorporated by reference herein in its entirety. It will be understood that a greater or lesser number of screens 86 may be used for each screen section 80. Likewise, it will also be understood that while finger screens are illustrated in the drawings of the present embodiment, other screens may be used as well.

Figure 5:
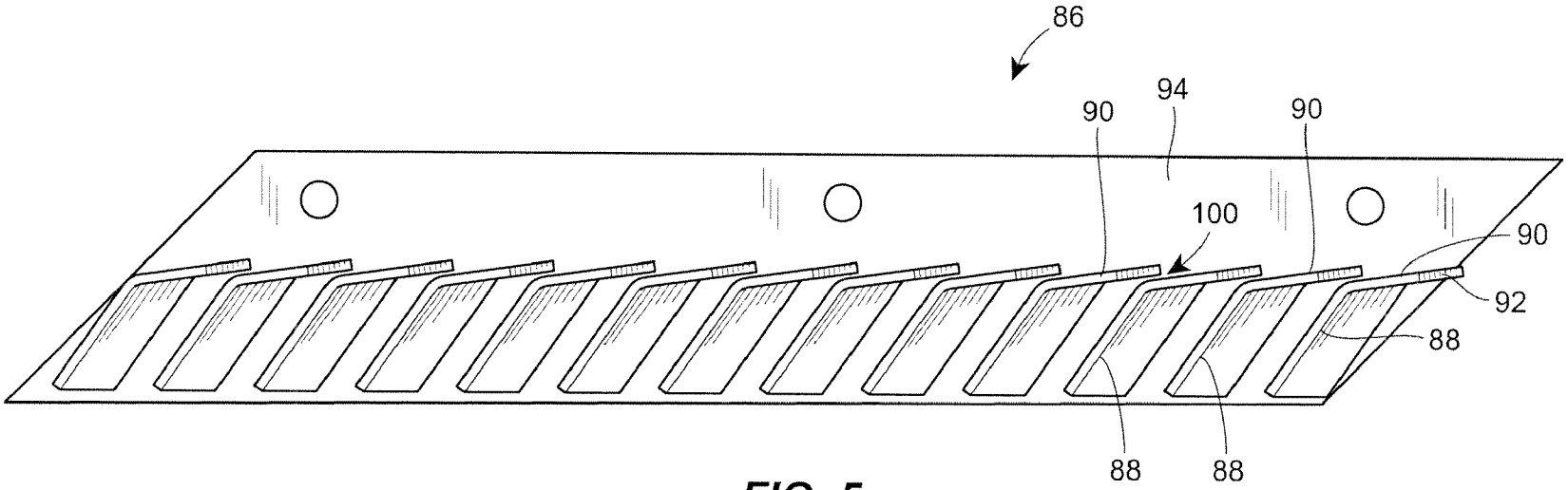
FIG. 5 is a fragmentary, enlarged, cross-sectional view of one of the finger screens that define a screen section of the first stage separator of FIG. 2.
Figure 6:
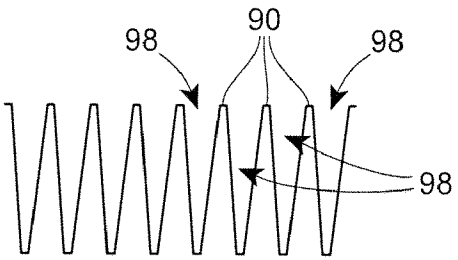
FIG. 6 is a fragmentary, enlarged, plan view of the finger screen of FIG. 5.

As is shown in greater detail in FIG. 5, each finger screen 86 may include a plurality of L-shaped plates 88, each plate 88 having a plurality of protrusions 90 (shown in enlarged view in FIG. 6) defined along the length of a first edge 92 thereof. The protrusions 90 define the "fingers" of the finger screen 86. The L-shaped plates 88 may be attached to a pair of mounting plates 94 (one of which is shown in FIG. 5) at either end of the L-shaped plates 88. The mounting plates 94 may have a plurality of apertures 96 formed therethrough to allow the screens 86 to be secured to the side walls 38, 40 of the trough 32, by fasters such as nuts and bolts, for example. In this way, the screens 86 may be selectively removed from the trough 32 for maintenance, repair and/or replacement.

The protrusions, or fingers, 90 define between them a plurality of spaces 98 (see FIG. 6) that permit certain constituent materials from a mixed material stream to pass therethrough, while limiting the passage of other materials in the mixed material stream. Additionally, the protrusions 90 of one L-shaped plate 88 may overlap with at least a portion of an adjacent L-shaped plate 88, but without abutting the adjacent L-shaped plate 88. As a consequence, a further space 100 is defined between the protrusions 90 and the adjacent L-shaped plates 88 through which certain materials may pass, while the passage of other materials therethrough may be limited. According to the present embodiment, the spaces 98, 100 may be of equal distance across.

The material that passes through the spaces 98, 100 may be deposited on the trough floor 36. As explained in greater detail below, the material that is deposited on the trough floor 36 may eventually pass along the trough floor 36 from the first end 42 of the trough 32 to the second end 44. Disposed at the second end 44 of the trough 32 are two chutes 102 (see, e.g., FIGS. 2 and 7), although in other embodiments a greater or lesser number of chutes 102 may be included. The chutes 102 assist in directing the material that is deposited on the trough floor 36 of the first stage separator 22 from the first stage separator 22 to the second stage separator 24.

Returning to FIGS. 2 and 3, as noted above, the upstream and downstream ends 82, 84 of adjacent screen sections 80 are spaced from each other. An L-shaped wall 120 is attached to the side walls 38, 40 in the space between adjacent screen sections 80. As seen in greater detail in FIGS. 8 and 9, a plurality of mounting brackets 122 are attached to the L-shaped walls 120. Each mounting bracket 122 includes two L-shaped plates 124, each having a first leg 126 that is secured to the L-shaped wall 120 and a second leg 128 through which two pins 130, 132 depend. A T-shaped cantilevered arm 134 is attached at a first end 136 to the plates 124 through the pins 130, 132 and has a second, free end 138. The T-shaped arm 134 has a material-retaining surface 140 that may be disposed at an angle relative to the screen section 80 when the T-shaped arm 134 is secured to the mounting bracket 122.

Figure 8:
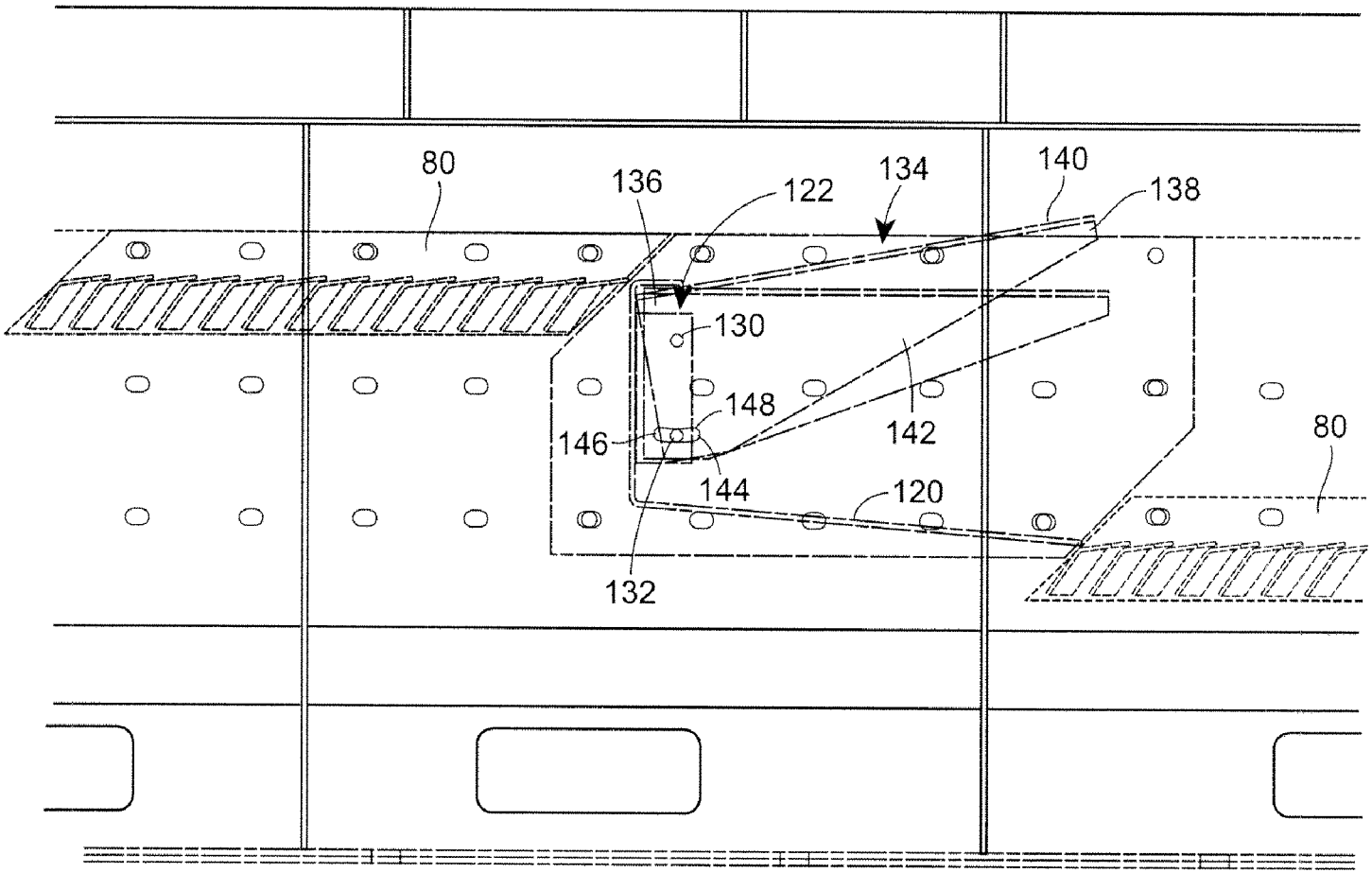
FIG. 8 is a fragmentary, enlarged side view of two adjacent screen sections of the first stage separator.
Figure 9:
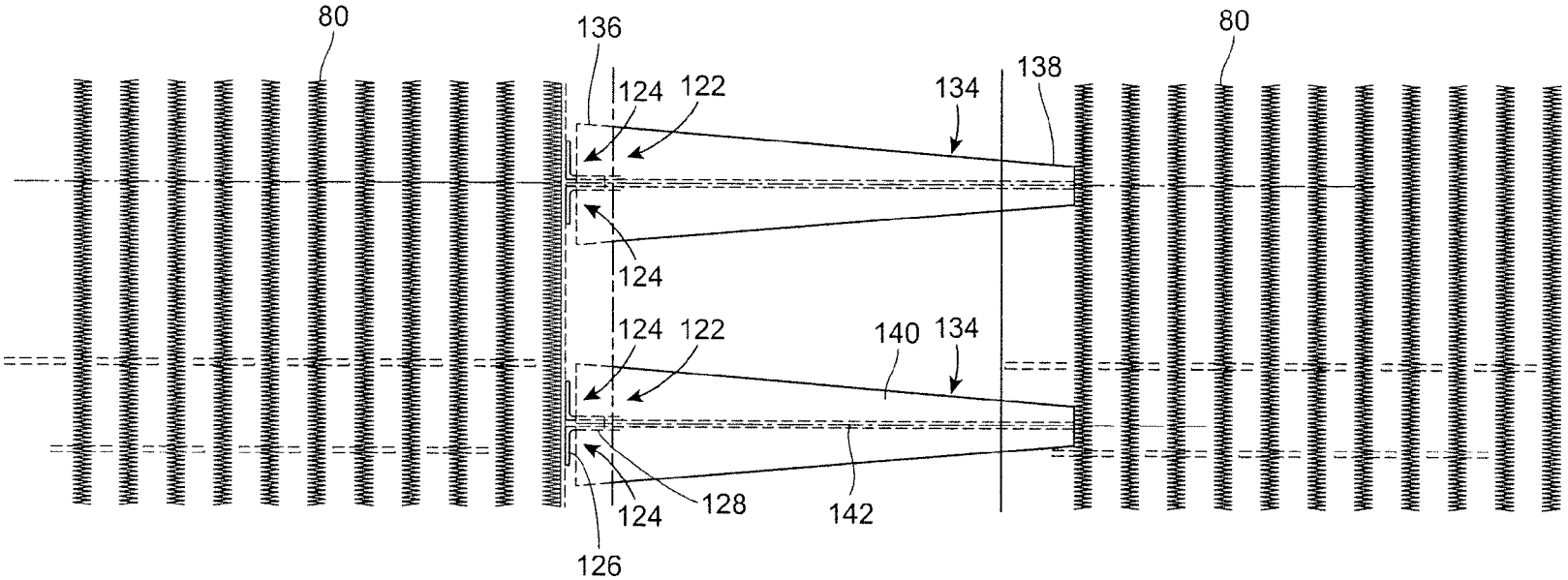
FIG. 9 is a fragmentary, enlarged plan view of the two adjacent screen sections of FIG. 8.

In particular, according to the embodiment illustrated in FIGS. 8 and 9, the arm 134 has a leg 142 with an aperture (not shown) to receive the first pin 130, and an arcuate slot 144 to receive the second pin 132. A mechanism (not shown) may be provided to releasably secure the first end 136 of the arm 134 to the mounting bracket 122 with the material-retaining surface 140 disposed at a desired angle relative to the horizontal. As a consequence, the angle of the material-retaining surface 140 is adjustable relative to the horizontal, within the limits set by the first and second ends 146, 148 of the arcuate slot 144 and the cooperation of the end 136 of the arm 134 and the L-shaped plate 124. According to other embodiments, however, the arm 134 may be fixedly and non-releasably secured to the mounting bracket 122.

Figure 7:
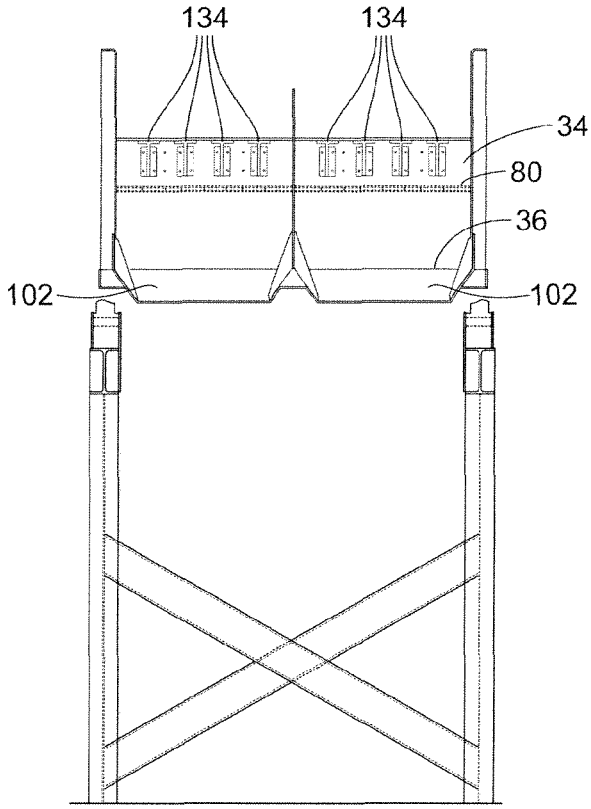
FIG. 7 is an end view of the first stage separator of FIG. 2 taken at the downstream, outlet end of the first stage separator.

As shown in FIGS. 3 and 7, there are eight arms 134 disposed between each of the screen sections 80 in the first stage separator 22. However, a greater or lesser number of arms 134 may be utilized in any embodiment of the separation system 20 according to the present disclosure. Moreover, if fewer arms 134 are used, the material-retaining surfaces 140 of the individual arms 134 may be larger than those illustrated, and, conversely, if a greater number of arms 134 are used, the material-retaining surfaces 140 of the individual arms 134 may be smaller than those illustrated. Alternatively, arms 134 having material-retaining surfaces 140 similar in relative size to those illustrated may be used even though fewer arms 134 are used.

Figure 10:
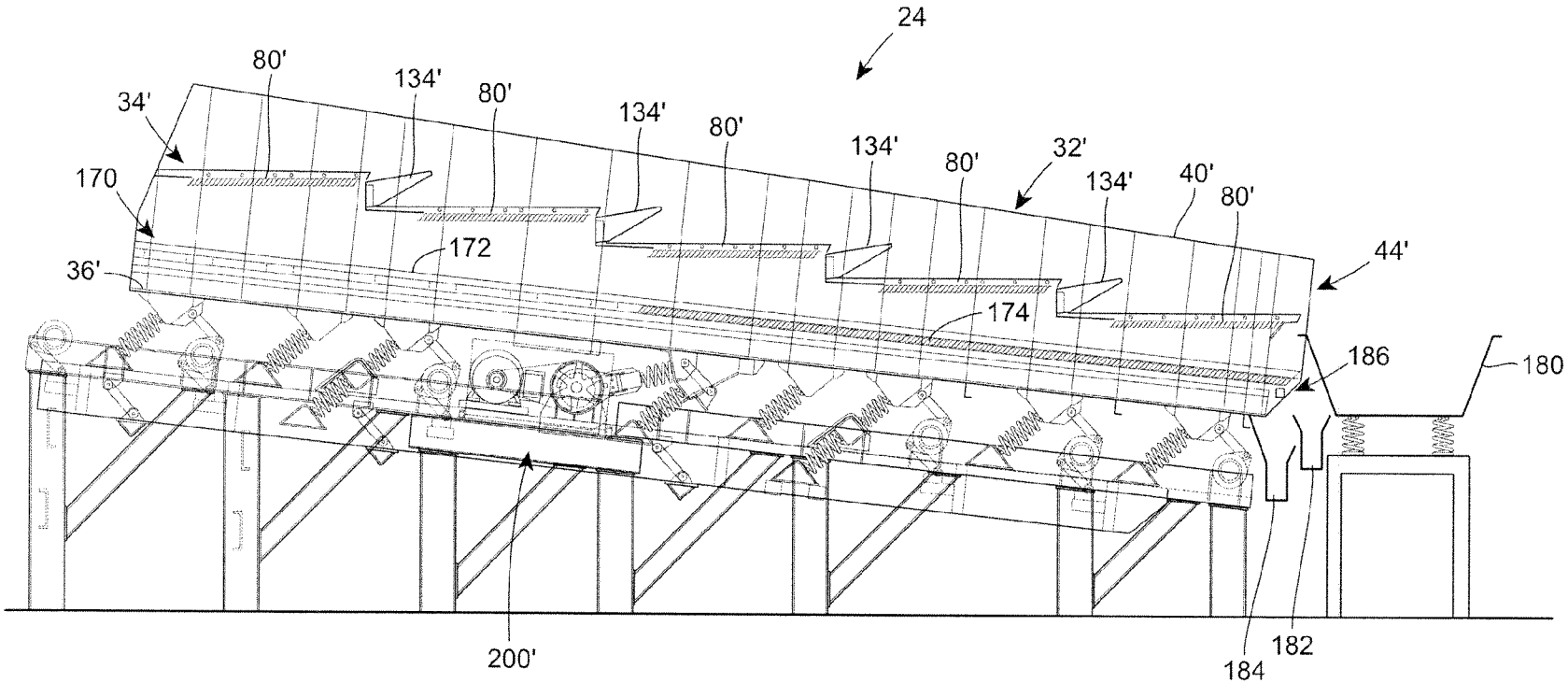
FIG. 10 is a side view of a second stage separator of the system illustrated in FIG. 1.
Figure 11:
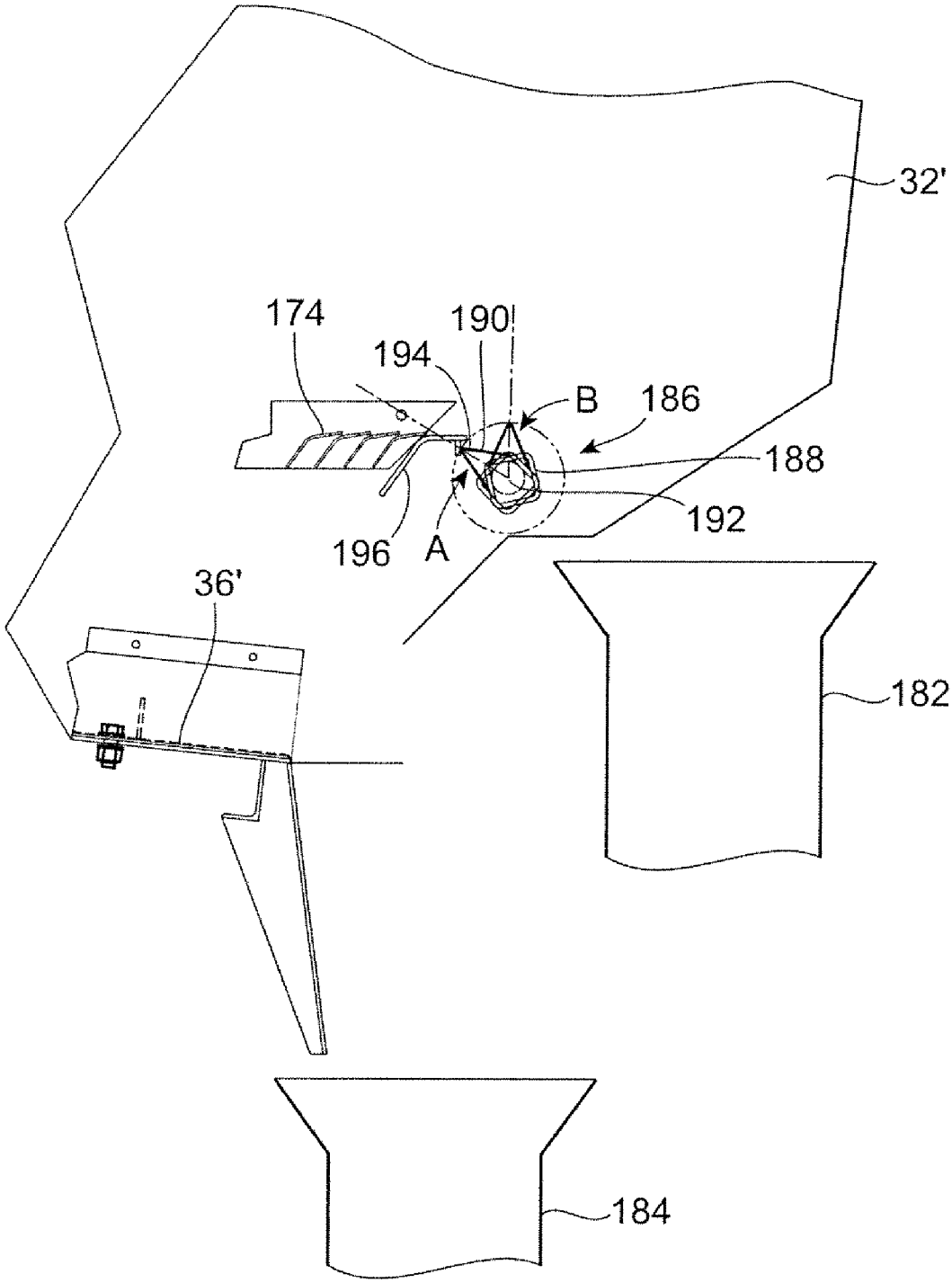
FIG. 11 is an enlarged, fragmentary cross-sectional view of the second stage separator in the vicinity of a gate.

Having thus discussed the first stage separator 22, the second stage separator 24 is now discussed with reference to FIGS. 10 and 11. Similar to the first stage separator 22, the second stage separator 24 includes a trough 32', with a floor 36' and side walls 38', 40'. The separator 24 also includes a separator deck 34' that is attached to the side walls 38', 40' and spaced from the trough floor 36'. Like the separator deck 34, the separator deck 34' includes five screen sections 80', but only four sets of cantilevered arms 134'.

Unlike the first stage separator 22, the second stage separator 24 includes a second separation deck 170. In this sense, the deck 34' may be referred to as the primary separation deck, while the deck 170 may be referred to as the secondary separation deck. The deck 170 includes a first, non-screen section 172 and a second screen section 174. The screen section 174 may be similar to the screen sections 80', in that the screen section 174 may include a plurality of individual screens and those individual screens may be finger screens. However, it is also possible for the screen section 174 to be defined by a single screen, and other than finger screens may be used.

According to one embodiment, the spaces between the individual fingers of the finger screens defining the screen section 174 may be smaller than the spaces between the fingers 90 of the finger screens 86. As a consequence, to the extent that material passes through the spaces in the screen section 174, these materials may be smaller in size, or finer, than the materials that pass through the screens 86, which in turn may be finer than the materials that do not pass through the screens 86. In this way, the materials that pass through the screen section 174 may be considered the smallest, or finest, materials separated from the mixed material stream that is introduced at the inlet end 42 of the first stage separator 22 from the source 50.

A number of conveyors may be disposed at the outlet end 44' of the second stage separator 24. For example, a first conveyor 180 may be disposed at the end 44' and adjacent the end of the screen section 80' farthest downstream on the primary separation deck 34'. This conveyor 180 may be a vibratory conveyor, such as is manufactured and sold by General Kinematics Corp. of Crystal Lake, Ill. According to the discussion above relative to the separation of the mixed material stream as it passes over the various screen sections 80, 80', 174, the materials deposited into the conveyor 180 would be those of generally the largest size.

At least two other conveyors or chutes 182, 184 may also be disposed adjacent the end 44' of the second stage conveyor 24. Included at the end 44' of the trough 32' is a gate 186, best seen in FIG. 11. The gate 186 is pivotally attached to the end 44' of the trough 32' adjacent the screen section 174, and may be used to direct the materials passing along the screen section 174 of the trough 32' into either the conveyor/chute 182 or the conveyor/chute 184, the materials passing along the floor 36' also being directed into the conveyor/chute 184 by virtue of the proximity of the conveyor/chute 184 to the end of the floor 36'.

As will be recognized, the gate 186 includes a shaft 188 to which a plate 190 is attached. The shaft 188 may be pivotally connected at either end to the walls 38', 40' of the trough 32'. Movement of the shaft 188 about its axis 192 causes the plate 190 to move between a first position ("A"), wherein an edge 194 of the plate 190 is proximate or adjacent to an extension plate 196 at the end of the screen section 174, and a second position ("B"), wherein the edge 194 of the plate 190 is spaced from the extension plate 196. With the plate 190 of the gate 186 in the first position (i.e., the gate 186 in the first position), material passing along the surface of the screen section 174 may pass along the plates 190, 196 into the chute 182. With the plate 190 of the gate 186 in the second position (i.e., the gate 186 in the second position), a certain fraction of the material passing along the surface of the screen section 174 may pass into chute 184. With the plate 190 spaced only slightly relative to the extension plate 196, the finest materials moving along the screen section 174 pass into the chute 184, while the coarser materials move over the plate 190 into the chute 182. The plate 190 may be controlled such that the space between the edge 194 of the plate 190 permits only certain grades of materials to mix with the materials moving along the floor 36', as desired, and a high degree variation may be possible in the space between the edge 194 and the plate 196. Eventually, the space between the edge 194 of the plate 190 and the plate 196 may be such that all the materials moving along the screen section 174 flow into the chute 184.

The movement of the shaft 188 about its axis 192 may be accomplished, for example, by a motor or manually (not shown).

The control of the gate 186 may be discrete or continuous, and may include a plurality of different second positions or only one second position. That is, according to certain embodiments, the second position of the plate 190 relative to the first position of the plate 190 may adopt any angle. According to other embodiments, the plate 190 may be disposed at only specific angles relative to the first position (for example, increments of five, ten or twenty degrees). Additionally, in certain embodiments, the gate 186 may adopt any number of second positions. In other embodiments, the gate may adopt a discrete number of second positions, the number of second positions possible being related to the specific angle increments possible between sequential second positions. According to still other embodiments, the gate may have only a first position and a second position (for example, wherein all materials passing along the screen section 174 are directed into the chute 184).

Also included with both the first and second stage separators 22, 24 is a vibratory generator 200, 200'. As discussed relative to the generator 200 shown in FIG. 2, the vibratory generator 200 may include a motor 202 with a shaft 204. The shaft 204 may be coupled to a shaft 206 by a drive belt 208. Attached to the shaft 206 is an eccentric mass 210. Attached to the eccentric mass 210 is a first end 212 of a link 214. A second end 216 of the link 214 is attached via a resilient member 218 to the trough 32; that is, a first end 220 of the resilient member 218 is fixedly secured to the second end 216 of the link 214, while the second end 222 of the resilient member 218 is fixedly secured to the floor 36 of the trough 32. A similar arrangement may be used for vibratory generator 200', although either or both of the generators 200, 200' may differ from that illustrated according to the knowledge of one skilled in the art, and may be, for example, a brute force vibratory generator or a two-mass vibratory generator according to another arrangement.

Having thus described the structure of the separator system 20, the operation of the separator system 20 is now discussed generally and relative to a particular application.

In general, a stream of mixed material enters the separator system 20 at the inlet end 42 of the first stage separator 22 from the source 50. The mixed material initially impinges upon the plate 48, which directs the mixed material to the first screen section 80. The mixed material moves across the screen section 80 under the influence of the vibratory motion imparted to the screen section 80, via the trough 32, by the vibratory generator 200. Specifically, the movement of the eccentric mass 210 about the shaft 206 is transmitted, via the link 214 and the resilient member 218, to the trough 32 to which the screens 86 that define the screen section 80 are attached.

As the mixed material moves across the first screen section 80, constituent materials within the mixed material stream that are smaller than the distance across the spaces 98, 100 between the fingers 90 may fall through the screens 86 and may be collected on the trough floor 36. The material collected on the trough floor 36 moves along the length of the trough 32 under the influence of the vibratory motion imparted by the vibratory generator 200. Likewise, the materials that are larger than the distance across the spaces 98, 100 move across the screen section 80 along the separation deck 34 until the materials come to the cantilevered arms 134.

The motion of the remainder of the mixed materials past the downstream end 84 of the screen section 80 is limited by the cantilevered arms 134, and, more specifically, by the material-retaining surfaces 140. As a consequence, the mixed material is retained, or "pools," on the screen section 80 for some duration of time. It is believed that the duration of the time that the material is retained on the screen section 80 may be influenced by varying the angle of the cantilevered arm 134 relative to the screen section 80. The additional time that the material spends pooled above the screen section 80 may aid in the separation of the materials within the mixed material stream. The additional time that the material spends pooled may permit any attached or interacting constituent materials (for example, materials attached to each other as a consequence of the relative moisture content of the mixed material) to be detached from each other, which action may be referred to as "scrubbing," after which the constituent materials may be separated according to their relative sizes. Moreover, the pooling of the material above each of the screen sections 80 may permit the material from the source 50, which may enter the inlet end 42 of the first stage separator 22 in discrete pulses, to achieve a more continuous throughflow.

Additionally, when the remaining materials moved to the next screen section 80, the material experiences a drop between adjacent sections 80, which drop is believed to limit the formation of a laminar state in the flow of the mixed materials, which may improve the motion of the constituent materials relative to each other, which motion may lead to improved separation of attached or interacting constituent materials. Furthermore, the arms 138 may also limit the formation of a laminar state in the flow of the mixed materials, which may also lead to an improvement in the relative motion of the constituent materials relative to each other.

Eventually, the materials that do not pass through the first screen sections 80 are passed along the length of the trough 32 under the influence of the vibratory motion imparted to the trough by the vibratory generator 200. After passing over the last set of arms 134, the material passing along the separation deck 34 of the first stage separator is passed through the inlet end 42' of the second stage separator 24 to the primary separation deck 34'. Similarly, the separated material passing along the trough floor 36 of the first stage separator 22 is directed through the chutes 102 through the inlet end 42' of the second stage separation 24 to the secondary separation deck 170.

As was the case with the material passing along the separation deck 34 of the first stage separator 22, the mixed material passes along the primary separation deck 34' of the second stage separator 24 under the influence of the vibratory motion imparted by the vibratory generator 200'. Materials that are smaller than the distance across the spaces 98', 100' in the screen sections 80' are deposited on the secondary separation deck 170, and the materials are periodically pooled by the cantilevered arms 134'. After traversing the primary separation deck 34', any materials that have not passed through the screens 80, 80' are directed into the first conveyor 180.

On the other hand, the material that passed through the screens 80 is combined on the secondary separation deck 170 with any materials that may pass through the screens 80'. This material is then passed over the screen section 174. The spaces between the fingers defining the screen section 174 are, as noted above, smaller than those of the screen sections 80, 80'. Consequently, those materials that are deposited on the floor 36' of the trough 32' are smaller than those passing along the secondary separation deck 170, which are in turn smaller than those passing along the primary separation deck 34'.

The materials passing along the secondary separation deck 170 and the trough floor 36' eventually exit the second stage separator 24 through the outlet end 44'. As mentioned above, the gate 186 may be used to direct the materials passing along the screen section 174 into the third conveyor/chute 184 or into the second conveyor/chute 182, along with the materials that traversed the floor 36'. In this fashion, the materials from the initial mixed materials stream may be separated into a set of three constituent material streams, two of which may be remixed to form a blended material stream.

One particular application for the above-mentioned system 20 and method is in the wood processing industry. For instance, to make particle board from lumber that has been harvested, the lumber may first be processed into a stream of wet chips of various sizes. The nature of the wet chip stream generated from the lumber harvested may be discrete, discontinuous or pulsed in nature; i.e., many wet chips may be generated when a log is introduced into a chipper, and then few wet chips may be generated in the lull period between the end of the chipping process on the first log and the introduction of a new log into the chipper. Furthermore, while the larger chips so generated may be used to form particle board, some of the smaller chips, typically referred to as fines, cannot be used to form particle boards because to do so would weaken the resultant board and the presence of fines may inhibit the interactions between the resin and the flakes that impart strength to the board product, and may be burned instead. Thus, an essential aspect of this process is the separation of the chips generated by the chipper into streams of chips of various sizes.

At the present time, disc screens are used to separate and convey the chips. However, the disc screens required to adequately separate the chips can be quite large, making it difficult to efficiently use the space within a given plant or placing constraints on the dimensions of the plant in the first instance. Moreover, before the chips can be passed across these disc screens, it is first necessary to dry the chips, as wet chips may cause the disc screens to malfunction or may otherwise inhibit the sorting process. Not only does the drying of the chips prior to processing across the disc screens increase the processing time and energy costs of the particle board fabrication process as a whole, water must be added to the fines prior to combustion, if this is the means of disposing of the fines, such that additional demands of time, money and resources must be are made.

By contrast, if the above-mentioned system 20 and method is used in this application, the space requirements within the plant may be minimized or optimized as it is believed that the overall space requirements for a separator system 20 according to the present disclosure should be significantly less than a disc system for the same output specifications. Moreover, the system 20 and method functions even in the presence of wet chips. Specifically, the relative motion of the flakes relative to each other may act to dislodge, or "scrub," any fines adhering to the surface of the flakes under the wet conditions. As a consequence, the required drying of the chips prior to processing as well as the rewetting of the fines post-processing may be limited. Furthermore, because of the action of the arms 134, 134', the flow of the material through the separator system 20 may be more continuous than that through existing disc screens, which are believed to do little or nothing to smooth the pulsed nature of the material entering existing separator systems. Further, the gate 186 may permit a portion of the coarser materials to be diverted along with the fines for combustion, if desired.

Figure 12:
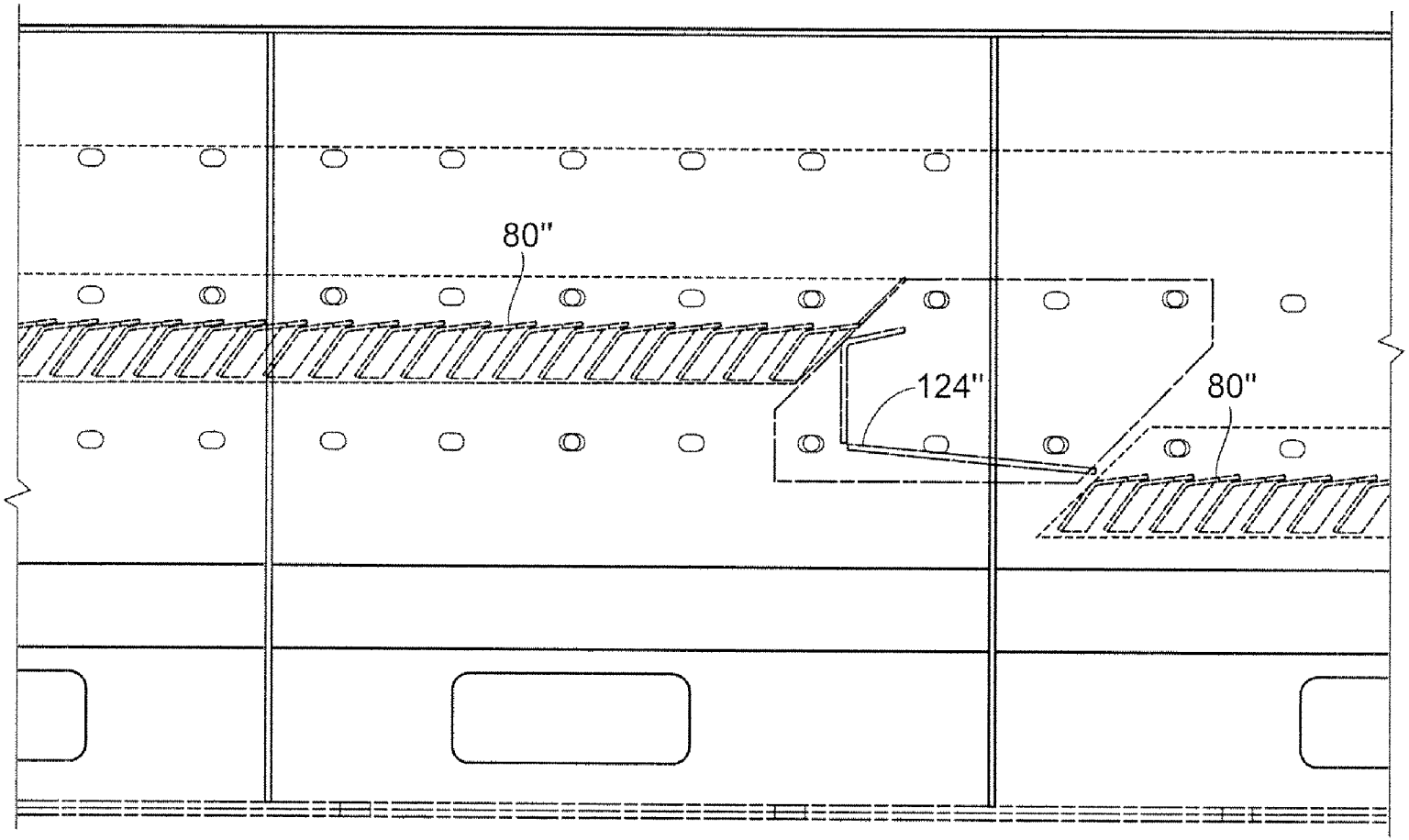
FIG. 12 is a fragmentary, enlarged side view of two adjacent screen sections of an alternative embodiment.

In addition to the system 20 described above, other alternative embodiments for the structure above are possible. As one such example, an alternative embodiment of a separation deck for use with either or both separators 22, 24 is illustrated in FIG. 12. According to this embodiment, adjacent screen sections 80" are separated by an L-shaped plate assembly 124". However, unlike the embodiments discussed above, the embodiment illustrated in FIG. 12 does not include arms 134, 134'. Instead the materials pass from the downstream end 84" of one screen section 80" to the upstream end 82" of the next screen section 80" after passing over the L-shaped plate assembly 124".

Further, other alternative embodiments for the method described above are possible. For example, while the method of operation of the system 20 was explained with reference to the fabrication of particle board, the same or similar method may be useful with other materials that required separation of a mixed material stream into constituent materials streams. This may most advantageously be used with other materials streams that contain wet materials, as was the case relative to wood separation discussed above, although the method may also be used with materials streams of dry materials. Likewise, while the method or a similar method may be advantageously used to smooth the throughflow where the flow of mixed material from a source is in discrete pulses, the method would also operate if the flow of mixed material from the source is continuous.

What is claimed is:

1. A vibratory separator system comprising:

at least one trough having an inlet end, a downstream, outlet end and a separation deck, the separation deck comprising at least one screen section having an upstream screen section end and a downstream screen section end, and a material-retaining surface attached at the downstream screen section end of the at least one screen section, the material-retaining surface having an upstream surface end immediately adjacent the downstream screen section end of the at least one screen section and a downstream surface end disposed at a higher elevation that the upstream surface end of the material-retaining surface to define an upwardly-directed, obtuse angle relative to the at least one screen section; and a vibratory generator coupled to the at least one trough.

2. The system according to claim 1, wherein the material-retaining surface is defined by a plurality of material-retaining surfaces, each spaced from the others so as to define a plurality of passages therebetween between opposing sides of the at least one trough.

3. The system according to claim 2, wherein the plurality of material-retaining surfaces have unsupported downstream ends.

4. The system according to claim 1, wherein the material retaining surface is defined by a plurality of cantilevered arms, each spaced so as to define passages between adjacent arms in a direction perpendicular to a direction of motion of the material in the at least one trough between the inlet and outlet ends.

5. The vibratory separator system according to claim 4, wherein the trough has side walls, the cantilevered arms have side edges that face one of side walls, and the side edges of adjacent arms define the passages therebetween.

6. The vibratory separator system according to claim 5, wherein the cantilevered arms have a surface between the side edges, the surface being tapered in width from the upstream end to the downstream end.

7. The vibratory separator system according to claim 4, wherein the cantilevered arms are pivotally attached to the trough at their upstream end.

8. The vibratory separator system according to claim 4, wherein the separation deck comprises a second screen section having an upstream end and a downstream end, the upstream end of the second screen section being disposed at a lower elevation than the downstream end of the at least one screen section, and each of the cantilevered arms extends from the downstream end of the at least one screen section to the upstream end of the second screen section.

9. The vibratory separator system according to claim 8, further comprising a solid plate disposed between the downstream end of the at least one screen section and the upstream end of the second screen section.

10. The vibratory separator system according to claim 9, wherein the solid plate is an L-shaped plate, with each of the cantilevered arms pivotally attached to the L-shaped plate at their upstream ends.

11. The vibratory separator system according to claim 10, wherein the cantilevered arms are adjustable to change the angle formed between the at least one screen section and the cantilevered arm.

12. The vibratory separator system according to claim 1, comprising a plurality of finger screens, the plurality of finger screens defining the at least one screen section.

13. The vibratory separator system according to claim 1, wherein the upstream and downstream ends of the at least one screen are at the same elevation.

14. The system according to claim 1, wherein the separation deck comprises a second screen section having an upstream end and a downstream end, the upstream end of the second screen section being disposed at a lower elevation than the downstream end of the at least one screen section, further comprising:

a gate disposed at the downstream end of the second screen section, the gate with a plate rotatable between a first position and a second position, the plate having a edge adjacent to the downstream end of the second screen section in the first position wherein material passing along the second screen section passes along the plate and spaced from the second screen section in the second position wherein material passing along the second screen section passing between the downstream end of the second screen section and the edge of the plate.

15. The system according to claim 14, wherein the plate is attached to a shaft that is pivotally connected at either end to the trough.

16. The system according to claim 14, comprising first and second conveyors, the first conveyor being disposed proximate to the gate to receive material that passes over the at least one screen section when the gate is in the first position, the second conveyor being disposed proximate to the at least one screen section to receive material that passes through the at least one screen section, the second conveyor also being disposed proximate to the gate to receive at least a portion of the material that passes over the at least one screen section when the gate is in the second position, but not in the first position.

* * * * *